US011124012B2

(12) United States Patent
Vadenne et al.

(10) Patent No.: US 11,124,012 B2
(45) Date of Patent: Sep. 21, 2021

(54) MULTIFUNCTIONAL WRITING INSTRUMENT

(71) Applicant: SOCIETE BIC, Clichy (FR)

(72) Inventors: Franck Vadenne, Bezons (FR); Etienne Michenaud, Montrouge (FR)

(73) Assignee: Societe BIC, Clichy (FR)

( * ) Notice: Subject to any disclaimer, the term of this patent is extended or adjusted under 35 U.S.C. 154(b) by 0 days.

(21) Appl. No.: 16/652,722

(22) PCT Filed: Oct. 16, 2018

(86) PCT No.: PCT/FR2018/052576
§ 371 (c)(1),
(2) Date: Apr. 1, 2020

(87) PCT Pub. No.: WO2019/077264
PCT Pub. Date: Apr. 25, 2019

(65) Prior Publication Data

US 2020/0238749 A1 Jul. 30, 2020

(30) Foreign Application Priority Data

Oct. 16, 2017 (FR) ..... 1759704

(51) Int. Cl.

| | |
|---|---|
| ***B43K 27/00*** | (2006.01) |
| ***B43K 24/14*** | (2006.01) |
| *B43K 7/12* | (2006.01) |
| *B43K 21/00* | (2006.01) |
| *B43K 24/02* | (2006.01) |
| *B43K 24/16* | (2006.01) |

(52) U.S. Cl.
CPC ..... *B43K 27/00* (2013.01); *B43K 24/146* (2013.01); *B43K 7/12* (2013.01); *B43K 21/006* (2013.01); *B43K 24/02* (2013.01); *B43K 24/16* (2013.01)

(58) Field of Classification Search
CPC ..... B43K 24/02; B43K 24/10; B43K 24/14; B43K 24/146; B43K 24/16; B43K 24/163; B43K 27/00
See application file for complete search history.

(56) References Cited

U.S. PATENT DOCUMENTS

| | | | | |
|---|---|---|---|---|
| 1,789,760 | A | 1/1931 | Kiedrowski | |
| 2,479,649 | A | 8/1949 | Thatcher | |
| 5,642,953 | A * | 7/1997 | Kobayashi | B43K 24/14 401/30 |
| 2002/0057937 | A1 | 5/2002 | Carroll et al. | |

(Continued)

OTHER PUBLICATIONS

International Search Report dated Feb. 27, 2019, in International Application No. PCT/FR2018/052576 (7 pages).

*Primary Examiner* — J C Jacyna
(74) *Attorney, Agent, or Firm* — Bookoff McAndrews, PLLC

(57) ABSTRACT

A multifunctional writing instrument comprising a body housing at least two writing elements, each writing element comprising a writing tip, a selection device configured to select one writing element from the at least two writing elements and a retraction device configured to move a selected writing element between a writing position in which the writing tip of the selected writing element protrudes from the body and a retracted position in which the writing tip of the selected writing element is retracted.

20 Claims, 5 Drawing Sheets

(56) References Cited

U.S. PATENT DOCUMENTS

| | | | | |
|---|---|---|---|---|
| 2005/0063767 | A1* | 3/2005 | Kobayashi | B43K 7/03 401/188 A |
| 2007/0280772 | A1 | 12/2007 | Mika | |
| 2019/0366756 | A1* | 12/2019 | Michenaud | B43K 24/18 |
| 2020/0238749 | A1* | 7/2020 | Vadenne | B43K 27/00 |
| 2020/0398607 | A1* | 12/2020 | Bez | B43K 24/04 |
| 2021/0078353 | A1* | 3/2021 | Michenaud | B43K 21/006 |
| 2021/0078355 | A1* | 3/2021 | Michenaud | B43K 27/02 |

* cited by examiner

MULTIFUNCTIONAL WRITING INSTRUMENT

CROSS REFENCE TO RELATED APPLICATION(S)

This application is a National Stage Application of International Application No. PCT/FR2018/052576, filed on Oct. 16, 2018, now published as WO2019/077264 and which claims priority to French Application No. FR1759704, filed on Oct. 16, 2017.

TECHNICAL FIELD

The disclosure relates to a multifunctional writing implement. For the record, a multifunctional writing implement is a writing implement comprising a plurality of writing elements, it being possible for each writing element to be used selectively.

PRIOR ART

The user of a multifunctional writing implement generally uses one particular writing element in a preferential manner with respect to the other writing element(s). However, when the preferred writing element is retracted, the user must check that the button he wishes to activate in order to move it into the writing position does indeed correspond to the preferred writing element, before activating the button in order to move the writing element into the writing position, at the risk of accidentally using a different writing element from the preferred writing element. There is therefore a need in this respect.

SUMMARY

One embodiment relates to a multifunctional writing implement comprising a body that houses at least two writing elements, each writing element comprising a writing tip and a selection device that is designed for selecting a writing element from the at least two writing elements, and a retraction device that is designed for moving the writing tip of a selected writing element between a writing position in which the writing tip of the selected writing element projects from the body, and a retracted position in which the writing tip of the selected writing element is pulled in.

In a general manner, it will be understood that the writing implement extends in an axial direction that corresponds to the direction of the axis of the body. A radial direction is a direction that is perpendicular to the axis of the body, and a circumferential or azimuthal direction corresponds to the direction that describes a ring around the axial direction.

In the following, and unless otherwise indicated, "writing implement" is intended to mean "multifunctional writing implement."

Of course, the writing implement can comprise two or more than two writing elements. In the following, and unless otherwise indicated, "the writing elements" is intended to mean "the at least two writing elements."

Within the meaning of the present disclosure, a writing element is formed by any element that comprises a writing tip. The writing tip may for example be a felt tip, a ballpoint or other type, a graphite lead, a lead of a mechanical pencil, a chalk, or any means that makes it possible to write on a substrate, or any tip (active or passive) that is designed for cooperating with a screen, for example a capacitive or resistive screen. For example, if the writing element comprises a ballpoint, it also corresponds to an ink reservoir. According to another embodiment, if the writing element comprises a lead of a mechanical pencil, it also corresponds to a mechanical pencil mechanism and a lead store. In the following, and unless otherwise indicated, the writing tip of any writing element is considered to be borne by a writing head, it being possible for the writing element to be fixed (e.g. ballpoint) or movable (e.g. mechanical pencil lead) with respect to the writing head.

The body is, of course, hollow and designed to receive writing elements. The body thus comprises an interior and an exterior.

It is to be understood that the selection device makes it possible to select a writing element, while the retraction device makes it possible to activate the writing element. Thus, within the meaning of the present disclosure, "select a writing element" is intended to mean "configure a writing implement such that the writing element can cooperate with the retraction device." Of course, it will be understood that the selection device makes it possible to select at most one writing element at a time. For example, the retraction device is designed to cooperate solely with the selected writing element. According to a first variant, when a writing element is selected using the selection device, the head of the writing element can remain pulled in within the body, in which case the retraction device can be used to move the writing element in/out. This first variant is particularly well suited for writing elements having a fixed writing tip, but can also be used for writing elements having a movable writing tip. According to a second variant which is particularly well suited for writing elements having a movable writing tip, when a writing element is selected using the selection device, the head of the writing element extends outside the body, in which case the retraction device can be used only to move the writing tip into/out of the writing head. Of course, within the writing implement, one writing element can be designed in accordance with the first variant, while another writing element can be designed according to the second variant. In other words, the first and second variants can co-exist within the same writing implement.

It is to be understood that the retraction device makes it possible to move the writing tip of the selected writing element between a writing position and a retracted position. For example, when the writing element comprises a fixed writing tip, such as a ball mounted on the head which is itself mounted on an ink reservoir, in the retracted position the writing tip is pulled into the body, while in the writing position the writing tip extends outside of the body. According to another embodiment, when the writing tip of the writing element is movable, such as a lead borne by a head of a mechanical pencil mechanism, in the retracted position the lead can be pulled into the mechanical pencil, it being possible for the head of the mechanical pencil to itself be pulled in within the body, or to extend outside of the body, or for the lead to extend outside of the head of the mechanical pencil, while the head is pulled in within the body, the lead not projecting beyond the body. Of course, in the writing position, a movable writing tip of this kind extends outside the body, it being possible for the head of the writing element to be outside or inside the body. In other words, in the case of the writing elements having a movable writing tip, the retraction device can be used only to extend and/or return the writing tip out of and/or into the head of the writing element (for example in order to move the lead of the mechanical pencil forward, and to allow for the return thereof into the mechanical pencil when the jaws of the mechanism of the mechanical pencil are released).

Thus, the user selects the writing element that he wishes to use by means of the selection device, and moves the writing tip between a retracted position and a writing position, using the retraction device. This achieves greater ease of use with respect to multifunctional writing implements of the prior art. Indeed, once the writing element is selected, the user can move the writing tip in/out at will, without worrying about whether the action will actually move the writing tip of the desired writing element in/out. When the user wishes to change the writing element, he can then easily select another writing element by virtue of the selection device.

In some embodiments, the body comprises a front portion and a rear portion, the front portion and the rear portion being movable in rotation relative to one another, the selection device comprising a cam that is rotatably coupled to the rear portion and designed to cooperate, in abutment, with the writing elements, the writing elements being rotatably coupled to the front portion.

The front portion is rotatably movable with respect to the rear portion (and vice versa), about the axial direction (i.e. in the circumferential direction).

During the rotation of the front portion with respect to the rear portion, the cam of the selection device is rotated by the rear portion, with respect to the front portion, and, depending on the azimuthal position thereof with respect to the writing elements, does not cooperate with any, or cooperates with one or the other of the writing elements. When the cam cooperates with one writing element, the writing element is considered to be selected. According to a variant, it is possible for no element to be selected.

A design of this kind makes it possible to easily select a writing element, while having a sufficiently compact structure for maintaining the ergonomic nature of the writing implement.

In some embodiments, the cam of the selection device and the retraction device are both rotatably coupled to the rear portion.

This makes it possible to ensure that the relative position between the cam of the selection device and the retraction device remains unchanged, whatever the relative position between the front portion and the rear portion. This ensures optimal interaction between the cam of the selection device and the retraction device, which increases the reliability and ease of use of the writing implement.

In some embodiments, the retraction device comprises a ratchet mechanism.

The ratchet mechanisms are well-known, reliable retraction mechanisms, and can be relatively compact. Devices of this kind are therefore particularly well suited to the writing implement according to the present disclosure.

In some embodiments, the ratchet mechanism comprises a rotary cam that cooperates, in abutment, with the cam of the selection device.

The rotary cam of a ratchet mechanism is the portion of the ratchet mechanism which, when the mechanism is actuated alternately assumes (i.e. is locked in) a first position and a second position that is different from the first position. Making the cam of the selection device cooperate with the rotary cam of the ratchet mechanism, for example in the axial direction within the writing implement, the cam of the selection device follows the movement, and thus remains locked in position, in cooperation with the rotary cam. Since the cam of the selection device cooperates with the selected writing element, such a configuration makes it possible to move the writing tip of the selected writing element into the writing position or into the retracted position. Of course, the cooperation of the two cams may be direct (i.e. without an intermediate element) or indirect (i.e. via an intermediate element). Such a configuration makes it possible to achieve reliable interaction and a relatively compact overall structure, by virtue of which the ergonomics of the writing implement is preserved.

In some embodiments, the ratchet mechanism comprises a piston that bears the cam of the selection device.

It will therefore be understood that the cam of the selection device can be a part that is coupled to the piston of the ratchet mechanism, or can form a single piece together with the ratchet mechanism. For the record, the piston of a ratchet mechanism is the part which receives the control movement generated by the user, by virtue of which the rotary cam is moved towards the first position or the second position.

This ensures perfect interaction between the selection device and the retraction device, as well as a certain degree of compactness, which provides a certain degree of reliability and compactness of the writing implement.

In some embodiments, at least one writing element is a mechanical pencil, the retraction device making it possible to move the lead of the mechanical pencil forwards when the mechanical pencil is in the writing position.

The writing implement according to the present disclosure is particularly well suited to mechanical pencils.

In some embodiments, the mechanical pencil comprises a writing head that is designed for bearing the lead, the lead forming a writing tip, the writing head projecting from the body when the mechanical pencil is selected using the selection device.

It will therefore be understood that the writing head projects from the body from the moment when the mechanical pencil has been selected. As described above, in a configuration of this kind, the retraction device allows only for the lead to be moved forwards, which is considered, within the meaning of the present disclosure, as moving the writing tip from a retracted position to a writing position. A writing device comprising a mechanical pencil of this kind is particularly easy to use.

In some embodiments, the mechanical pencil comprises a writing head that is designed for bearing the lead, the lead forming a writing tip, when the mechanical pencil is selected using the selection device the mechanical pencil is movable between an extended position in which the writing head projects from the body, and an indrawn position in which the writing head is pulled into the body by means of the retraction device, and when the mechanical pencil is in the extended position the retraction device makes it possible to move the lead forwards during a partial movement with respect to a required movement of the retraction device for moving the mechanical pencil from the extended position into the indrawn position.

It will therefore be understood that the head does not project from the body when the mechanical pencil is selected (i.e. indrawn position). It is therefore necessary to actuate the retraction device in order that the head is outside the body. When the head is arranged outside of the body (i.e. in the extended position), partial actuation of the retraction device makes it possible to move the lead forwards, while complete actuation of the retraction device makes it possible to return the head into the inside of the body, i.e. in the indrawn position. A writing device that comprises a mechanical pencil of this kind makes it possible to pull in the head of the mechanical pencil, even when this is selected, which makes it possible to protect the pencil.

In some embodiments, the body comprises a front portion and a rear portion, the front portion and the rear portion being mounted on an intermediate portion and being movable in rotation relative to one another, the selection device comprises a cam that is rotatably coupled to the rear portion and designed to cooperate, in abutment, with the cam followers of the writing elements, the writing elements being rotatably coupled to the front portion and borne by the intermediate portion, the intermediate portion comprising at least as many guides, extending over the entire length of the intermediate portion, as there are writing elements, each cam follower being received in a sliding manner in a guide.

Of course, the length of the intermediate part extends in the axial direction. It will therefore be understood that the writing elements can slide within the guide, and thus within the intermediate portion, throughout the intermediate portion, in the axial direction. This makes it possible, when the front portion and the rear portion can be dismantled from one another (it being possible for one or the other to remain coupled to the intermediate portion), to be able to easily change the writing element. A structure of this kind thus makes it possible for the writing implement to be rechargeable and/or makes it possible to select the writing elements that equip the writing implement, i.e. to design the writing implement as desired.

BRIEF DESCRIPTION OF THE DRAWINGS

The disclosure will be better understood upon reading the following detailed description of different embodiments, given by way of non-limiting examples. This description refers to the enclosed pages of the drawings, in which.

DETAILED DESCRIPTION OF EMBODIMENTS

Figure 1:
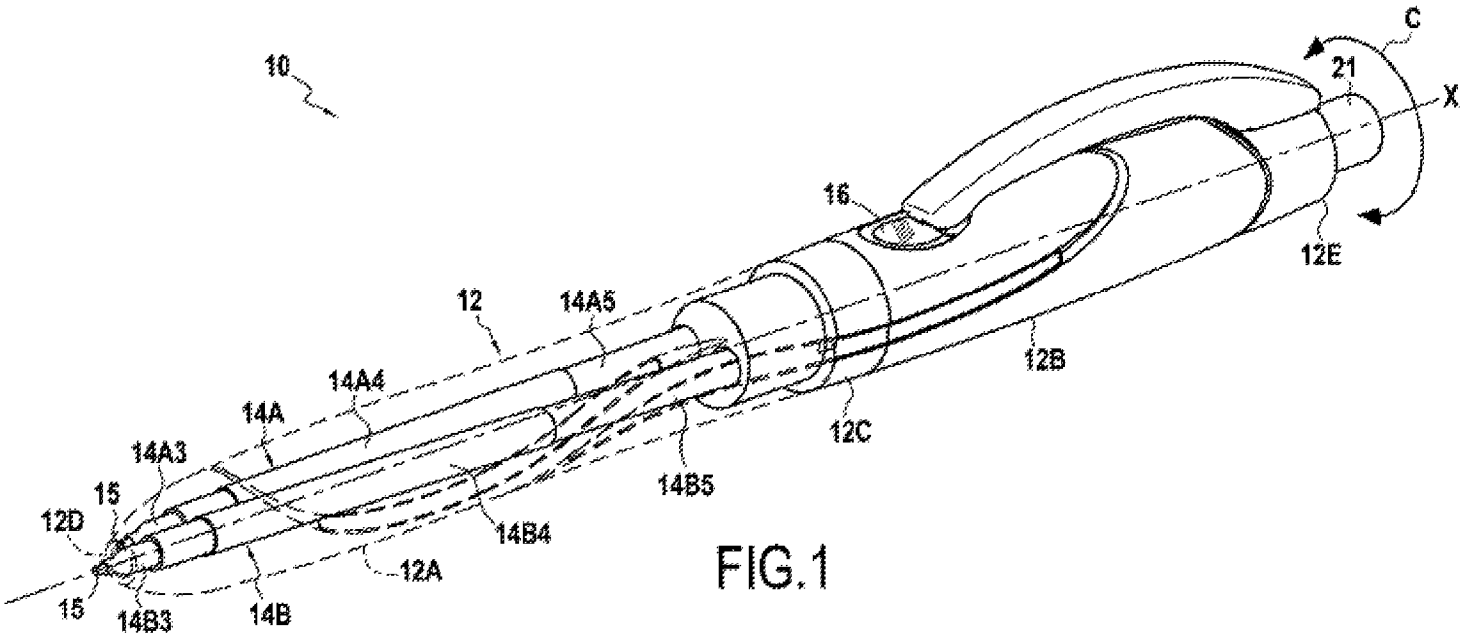
FIG. 1 is a perspective view of a multifunctional writing implement.

FIG. 1 shows a multifunctional writing implement 10 that extends in an axial direction X and comprises a body 12 which, in this embodiment, houses two writing elements 14A and 14B, i.e. two mechanical pencils. Of course, according to a variant, the writing instrument comprises more than two writing elements. According to another variant, one of the (or the two) writing element(s) is (are) not a (one of the) mechanical pencil(s). In this embodiment, the mechanical pencils 14A and 14B each comprise a writing head 14A3, 14B3, a mechanism for moving the lead 14A4, 14B4 forwards, and a lead store 14A5, 14B5. A lead (or writing tip) 15 is borne by each head 14A3, 14B3.

In this embodiment, the body 12 comprises a front portion 12A, a rear portion 12B and an intermediate portion 12C. The front and rear portions 12A, 12B are each mounted on the intermediate portion, so as to be rotatable relative to one another about the axial direction X (i.e. in the circumferential direction C). In this embodiment, the front portion 12A is rotatably coupled to the intermediate portion 12C (for example by means of a screw and clamping assembly having a particular torque, or by means of clipping using a coupling ergo), while the rear portion 12B is rotatable about the axial direction X with respect to the intermediate portion 12C (for example by axial clipping by virtue of annular reliefs, allowing for rotations about the axial direction X). In FIG. 1, the front portion 12A is shown as being transparent, as a result of which the writing elements are visible. Of course, the different elements of the body 12, and in particular the front portion 12A, can be transparent or opaque, such that the user can see, or not, the interior of the writing implement 10. The mechanical pencils 14A and 14B are borne by the intermediate portion 12C. Since the intermediate portion 12C is coupled to the front portion 12A so as to be rotatable about the axial direction X, the mechanical pencils 14A and 14B are rotatably coupled to the front portion via the intermediate portion 12C.

The body 12, in this embodiment the rear portion 12B, comprises a transparent window 16 for viewing an indicator of the relative position of the front portion 12A with respect to the rear portion 12B, by virtue of which it is possible to determine the selected writing element. In this embodiment, a mark "A" indicates that the mechanical pencil 14A is selected (see FIG. 3B to 3E), whereas a mark "B" indicates that the mechanical pencil 14B is selected (see FIGS. 1, 4B and 4C).

The writing device 10 will now be described in greater detail, with reference to FIG. 2. The rear portion 12B is shown cut away, as a result of which the selection device 18 and the retraction device 20 are visible.

The selection device 18 comprises a cam 18A that is designed for cooperating, in abutment, with the mechanical pencils 14A, 14B, and more particularly, in this embodiment, with the cam followers 14A1 and 14B1 of the mechanical pencils 14A, 14B. The cam 18A is received in a slideway 1261 of the rear portion 12B, as a result of which the cam 18A can slide in the axial direction X, with respect to the rear portion 12B, and is coupled to the rear portion 12B so as to be rotatable about the axial direction X. Furthermore, in this embodiment, the rear portion 12B comprises an inside shoulder 12B2 (of course coupled to the rear portion 12B) which extends the cam profile 18A when the retraction device 20 is in a configuration corresponding to the retracted position of the writing elements. As a result, owing to the cam 18A and the shoulder 12B2, the selection device 18 has a closed cam profile that is oval in shape, the plane of the oval being inclined relative to the axial direction X. The distal end of the cam 18A is designed to cooperate with the cam followers 14A1 and 14B1 by way of being complementary in shape. In this embodiment, the distal end of the cam 18A has a concave shape 18A1 that is designed to receive the convex shape of the cam followers 14A1, 14B1. Thus, when the cam 18A cooperates with a cam follower 14A1 or 14B1, the cam follower is received in the concavity 18A1, which forms a hard spot when the rear portion 12B is intended to be rotated with respect to the front portion 12A, indicating that a mechanical pencil is selected.

By virtue of the cam profile formed by the cam 18A and the shoulder 12B2 of the selection device 18, the rear portion 12B can rotate 360° (three hundred and sixty degrees) relative to the front portion 12A, about the axial direction X, in one direction or the other, by means of successive selection of the mechanical pencil 14A and the mechanical pencil 14B. Of course, according to a variant, the cam profile is formed solely by the cam 18A. According to another variant, the relative rotational travel between the front portion 12A and the rear portion 12B is less than 360°.

During the rotation of the front portion 12A relative to the rear portion 12B (or vice versa), in order to select a mechanical pencil, the cam 18A cooperates with the cam followers 14A1 and 14B1 in a bearing manner in accordance with the circumferential C and axial X directions. In order to ensure that the mechanical pencils 14A and 14B remain in position within the intermediate portion 12C, the intermediate portion 12C comprises two guides 12C1 and, in this embodiment, axial grooves 12C11 that lead into axial through-holes 12C12. Each groove/hole 12C11/12C12 pair extends over the entire axial length of the intermediate portion 12C. The cam followers 14A1 and 14B1 are received in a sliding manner within the grooves 12C11, while the rest of the mechanical pencils 14A and 14B extends in part inside and in part beyond the holes 12C12. Compression springs 14A2, 14B2 are arranged, respectively, between the followers 14A1, 14B1 and the intermediate portion 12C, within the grooves 12C11. The springs are useful in particular for the use of the retraction device 20 described below.

The mechanical pencils 14A and 14B are thus guided in the axial direction, by the guides 12C1, in particular when the cam 18A engages with the pencils. When the cam 18A cooperates with a mechanical pencil, the mechanical pencil is pushed towards the front of the writing device (i.e. the distal end 12D in FIG. 1). This corresponds to the position of the mechanical pencil 14B in FIGS. 1 and 2. When the cam 18A does not cooperate with a mechanical pencil, the mechanical pencil is pushed towards the back of the writing device (i.e. the rear end 12E in FIG. 1), by means of the spring. This corresponds to the position of the mechanical pencil 14A in FIGS. 1 and 2.

Figure 2:
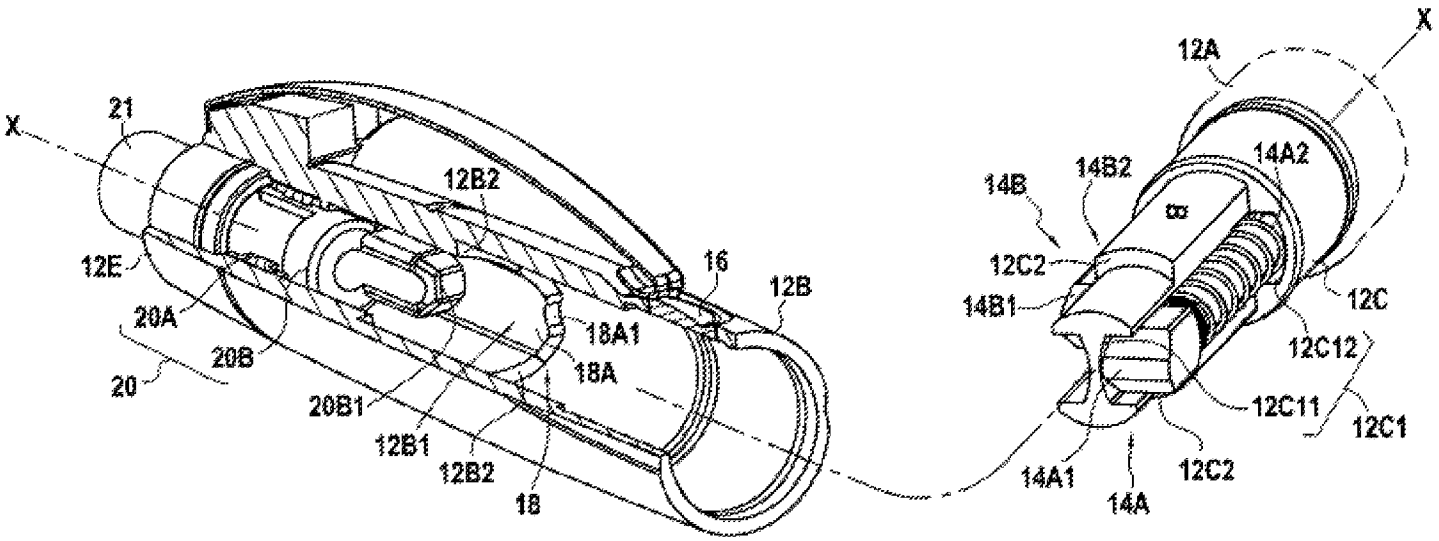
FIG. 2 is a partial cut-away, exploded view of a portion of the writing implement of FIG. 1, FIG. 3A to 3E show the selection of a first writing element, and the phases thereof, on the basis of the retraction device.

It will be noted that, in FIG. 2, the rear portion 12B is separated from the intermediate portion 12C, such that the mechanical pencils 14A, 14B can be retracted. Indeed, the front portions of the mechanical pencils 14A and 14B that extend into the front portion 12A can slide freely within the holes 12C12, as a result of which they can be retracted in order to be replaced.

The retraction device 20 is a ratchet mechanism which is furthermore known to a person skilled in the art. In this embodiment, the ratchet mechanism 20 comprises a rotary cam 20A and a piston 20B, the teeth of the rotary cam 20A cooperating with the teeth of the piston 20B. The piston 20B is driven in a translational manner, in the axial direction X, by virtue of a button 21 that is arranged at the rear end 12E of the body 12. Of course, according to a variant, any other type of ratchet mechanism may be used.

The piston 20B forms a single piece with the cam 18A of the selection device 18. The rotary cam 20A cooperates, in abutment and in the axial direction X, with the cam 18A/piston 20A, via the teeth of the piston 20B. In this embodiment, since the cam 18A and the piston 20B form a single piece, and the cam 18B is rotatably coupled to the rear portion 12B, the piston 20B, and thus the ratchet mechanism 20, is also rotatably coupled to the rear portion 12B.

As a result, the ratchet mechanism 20 cooperates with the writing elements 14A, 14B via the cam 18A of the selection device 18, by virtue of which the writing tips of the writing elements can be moved between a retracted position and a writing position (described below). When the cam 18A is engaged with a mechanical pencil, the spring 14A2 or 14B2 of the mechanical pencil compresses the ratchet mechanism, which allows for the use thereof.

It will be noted that the piston 20B comprises a stop 20B1 that is arranged radially inside the cam 18B and is designed so as to cooperate, in abutment, with the axial shoulders 12C2 of the intermediate portion 12C that are arranged between the guides 12C1, in the circumferential direction C. This prevents actuation of the ratchet mechanism 20 when the cam 18A does not cooperate with the mechanical pencil 14A or 14B. In this embodiment, the stop 20B1 is aligned with one of the guides 12C1 when a mechanical pencil 14A or 14B is selected by the selection device 18, ensuring that the stop cannot lock the ratchet mechanism 20 when a mechanical pencil is selected.

It will also be noted that the intermediate portion 12C bears a mark "B," which is visible through the window 16 when the relative position between the intermediate portion 12C and the front portion 12A, with respect to the rear portion 12B, corresponds to the engagement of the cam 18A with the mechanical pencil 14B. A mark "A," which is not visible in FIG. 2 and is diametrically opposed to the mark "B," is visible through the window 16 when the relative position between the intermediate portion 12C and the front portion 12A, with respect to the rear portion 12B, corresponds to the engagement of the cam 18A with the mechanical pencil 14A. The marks "A" and "B" form an indicator of the relative position of the front portion 12A (and the intermediate portion) with respect to the rear portion 12B.

The mode of operation of the writing implement 10 will now be described with reference to FIGS. 3A to 3E, and 4A to 4C.

Figure 3A:
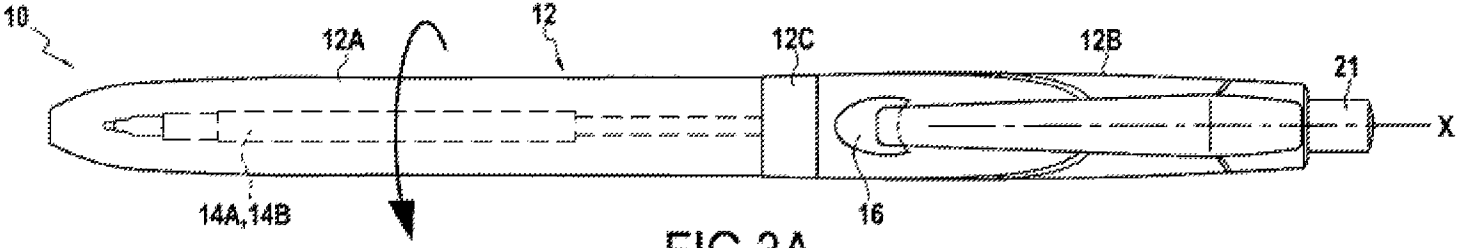

In FIG. 3A, no mechanical pencil is selected by the selection device 18, since no mark A or B is visible through the window 16. In order to select a mechanical pencil, for example the mechanical pencil 14A, the rear portion 12B is rotated 180° relative to the front portion 12A, in accordance with the arrow shown in FIG. 3A. Following this rotation, the writing implement 10 is configured as shown in FIG. 3B.

Figure 3B:
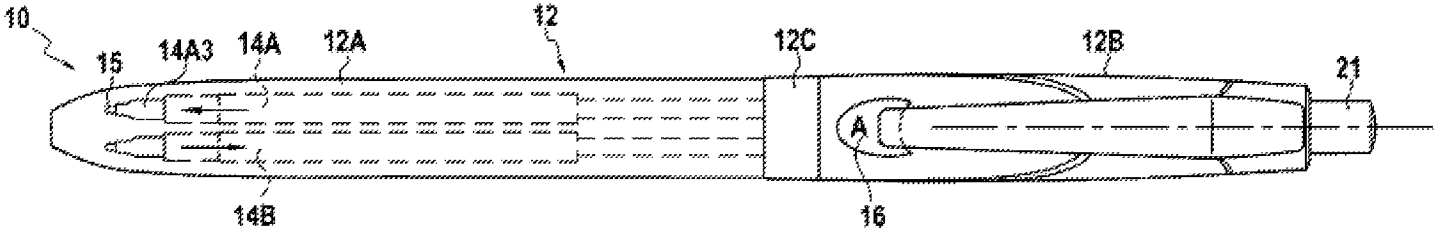

In FIG. 3B, the mechanical pencil 14A is selected, and the mark A is visible through the window 16. Thus, the cam 18A of the selection device 18 cooperates, in abutment, with the cam follower 14A1 (not shown in FIG. 3B), such that the mechanical pencil 14A is moved forwards (it will be noted that the mechanical pencils 14A and 14B are not of the same length, which explains why the heads thereof are at the same axial position in FIG. 3, even though the mechanical pencil 14A has been moved forward (see the arrows in FIG. 3B), since the mechanical pencil 14B is longer than the mechanical pencil 14A. In this embodiment, by virtue of the cam profile formed by the cam 18A and the shoulder 12B2, the mechanical pencil 14B is simultaneously moved towards the rear, when the mechanical pencil 14A is moved forwards, but of course, according to a variant, the mechanical pencil 14B could remain in the axial position when the mechanical pencil 14A is moved forwards. The reverse also applies). The head 14A3 and the lead 15 are pulled in within the body 12. The mechanical pencil 14A is thus in the indrawn position. In order to move the head 14A3 into the extended position, the ratchet mechanism 20 is actuated by pressing the button 21, as is shown in FIG. 3C, by an axial path C1.

Figure 3C:
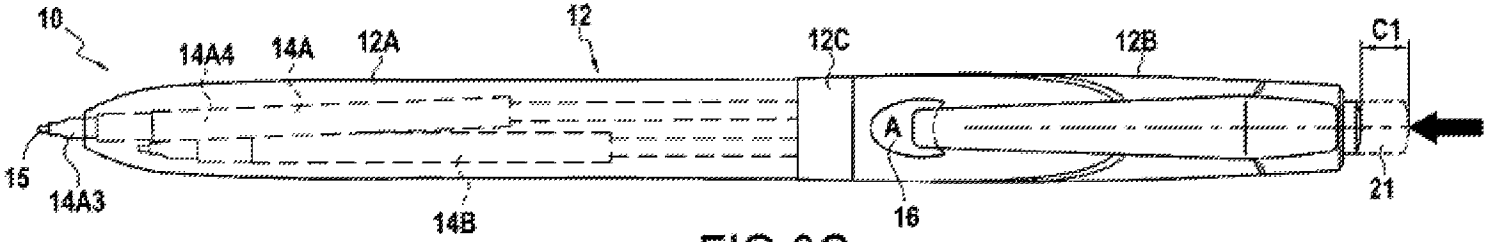
Figure 3D:
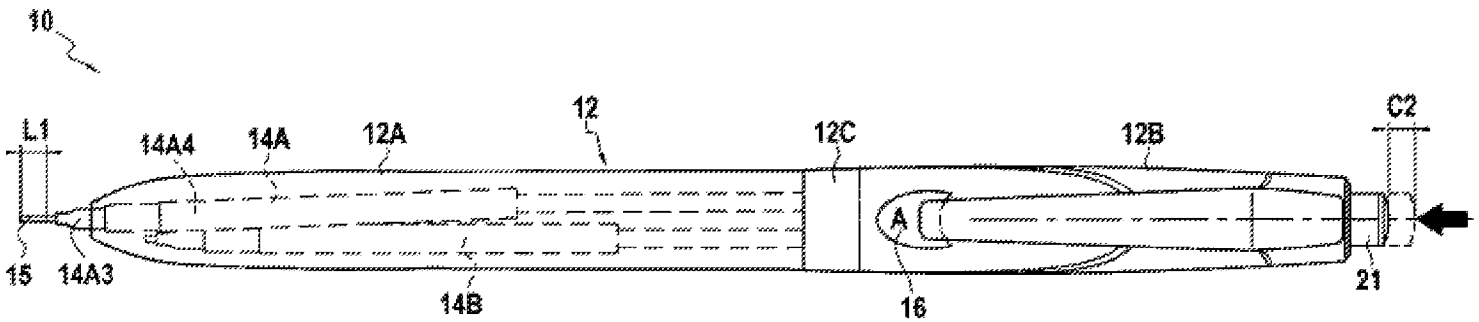

In FIG. 3C, the head 14A3 is outside of the body 12, and is therefore in the extended position. In this embodiment, the lead 15 projects from the head 14A3. In order to move the lead 15 forwards, it is sufficient to partially actuate the ratchet mechanism 20 by pressing the button 21, as shown in FIG. 3D, by an axial path C2 that is smaller than the axial path C1. It will be noted that the ratchet mechanism 20 is designed such that the partial actuation thereof by a path C2 does not allow for effective actuation, and therefore the head 14A3 remains outside the body 12, in the extended position. However, a path C2 of this kind drives the mechanism for advancing the lead 14A4 into abutment against the front portion 12A, inside the front portion 12A (configuration not shown), which results in actuation of the mechanism for moving the lead 14A4 forwards, and thus moves the lead 15 forwards by a length L1 (see FIG. 3D).

Figure 3E:
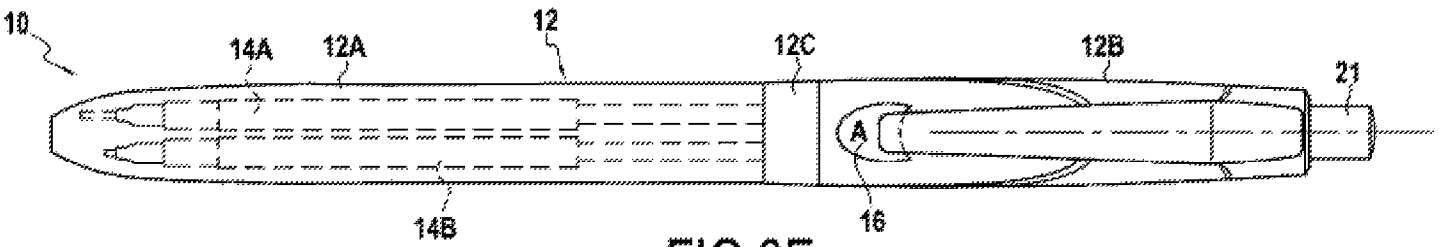

In FIG. 3D, the lead 15 is moved forwards by a length L1, following the partial actuation of the ratchet mechanism 20. The lead 15 is thus moved forwards into the writing position. For the record, within the meaning of the present disclosure, moving the lead forwards is to be understood as moving the writing tip from the retracted position into the writing position. In order to return the lead into the retracted position, the button 21 is pressed again, in accordance with an axial path C1, which again actuates the ratchet mechanism 20, the mechanical pencil 14A returning to the indrawn position, as a result of which the lead 15 is pulled into the body and no longer projects from the body: it is therefore in the retracted position, as shown in FIG. 3E. According to an alternative, it is possible to again partially activate the ratchet mechanism 20, as is shown in FIG. 3D, which releases the jaws (not shown) of the mechanism for moving the lead 14A4 forwards, and makes it possible to return the lead, manually, within the head 14A3 before releasing the button 21. Since the lead is thus pulled into the head (configuration not shown), the lead is considered to have been returned to the retracted position by virtue of the ratchet mechanism 20, the head 14A3 still being in the extended position.

When the mechanical pencil 14A is returned to the indrawn position, as is shown in FIG. 3E, it is possible to once again pivot the front portion 12A relative to the rear portion 12B in order to select the other mechanical pencil, or indeed to not select any mechanical pencil.

It will be noted that, according to a variant, the mechanical pencil 14A could be replaced by a fixed-point writing element, for example a ballpoint (or other) writing element. In this case, the indrawn/extended positions of the mechanical pencil 14A correspond to the retracted/writing positions of a fixed-point writing element, the partial actuation of the ratchet mechanism 20 having no effect.

Figure 4A:
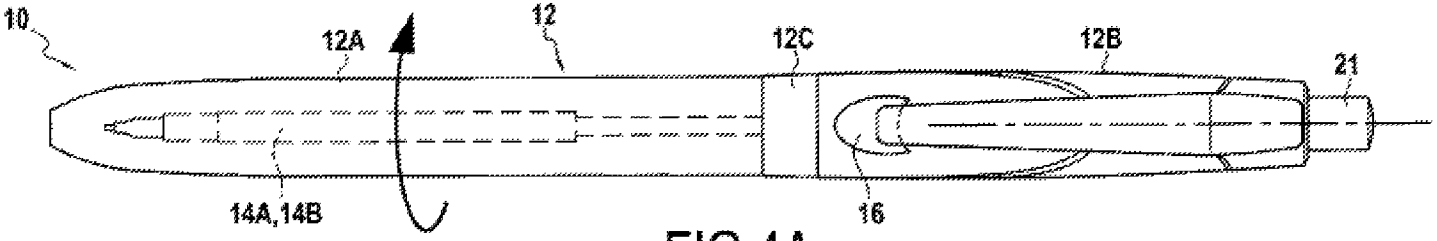
FIG. 4A to 4C show the selection of the second writing element, and the phases thereof, on the basis of the retraction device.

In FIG. 4A, no mechanical pencil is selected by the selection device 18, since no mark A or B is visible through the window 16. In order to select a mechanical pencil, for example the mechanical pencil 14B, the rear portion 12B is rotated 180° relative to the front portion 12A, in accordance with the arrow shown in FIG. 4A (i.e. in the opposite direction of rotation compared with FIG. 3A. Alternatively, the front and rear parts could be rotated in a relative manner by 180° in the same direction as that shown in FIG. 3A, in a manner deviating from the configuration of FIG. 3B or 3E). Following this rotation, the writing implement 10 is configured as shown in FIG. 4B.

Figure 4B:
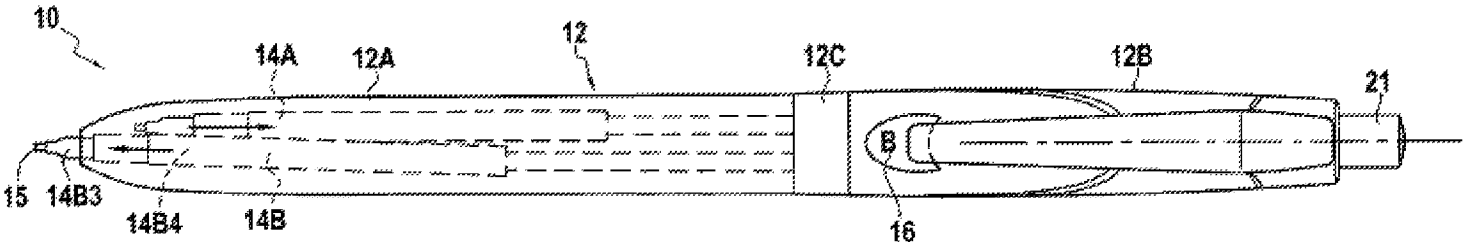

In FIG. 4B, the mechanical pencil 14B is selected, and the mark B is visible through the window 16. Thus, the cam 18A of the selection device 18 cooperates, in abutment, with the cam follower 14B1 (not shown in FIG. 4B), such that the mechanical pencil 14B is moved forwards. The head 14B3 projects from the body 12. It will be noted that selecting the mechanical pencil 14B causes the head 14B3 thereof to extend, whereas selecting the mechanical pencil 14A does not cause the head 14A3 thereof to extend because the axial length of the mechanical pencil 14B is greater than the axial length of the mechanical pencil 14A.

Figure 4C:
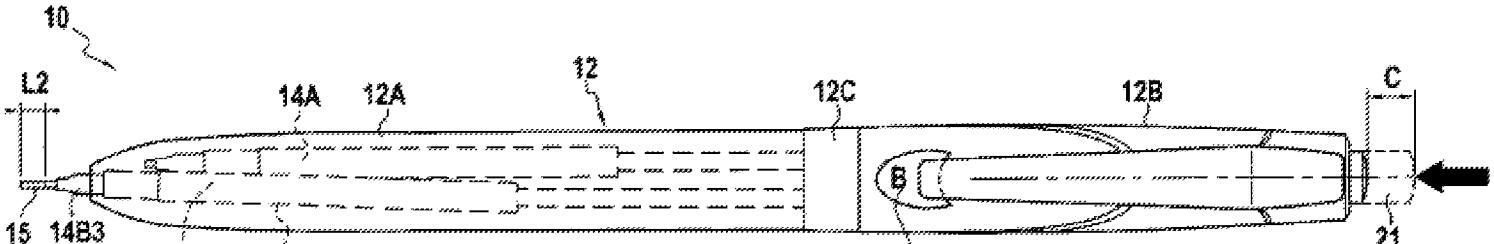

In this embodiment, the lead 15 projects from the head 14B3. In order to move the lead 15 forwards, it is sufficient to partially actuate the ratchet mechanism 20 by pressing the button 21, as shown in FIG. 4C, by an axial path C (which may be, but is not necessarily, equal to the axial path C1). A path C of this kind drives the mechanism for moving the lead 14B4 forwards, into abutment against the front portion 12A, inside the front portion 12A (configuration not shown), which results in actuation of the mechanism for moving the lead 14B4 forwards, and thus moves the lead 15 forwards by a length L2. It will be noted that the axial path required for actuating the mechanism for moving the lead 14B4 forwards is smaller than the axial path required for effectively actuating the ratchet mechanism 20. Since the head of the mechanical pencil 14B is outside the body 12 when selected by the selection device 18, the actuation of the ratchet mechanism 20 has no effect other than to move the lead 15 forwards. For the record, within the meaning of the present disclosure, moving the lead forwards is to be understood as moving the writing tip from the pulled in position into the writing position. In order to move the lead 15 into the retracted position (i.e. pulled in), it is possible to either deselect the mechanical pencil 14B using the selection device 18, which causes the head 14B3, and thus the lead 15, to be moved inside the body 12, or to once again activate the ratchet mechanism 20 as is shown in FIG. 4C, which releases the jaws (not shown) of the mechanism for moving the lead 14B4 forwards, and makes it possible to return the lead, manually, within the head 14B3 before releasing the button 21. Since the lead is thus pulled into the head 14B3, the lead is considered to have been returned to the retracted position by virtue of the ratchet mechanism 20.

Although the present disclosure has been described with reference to specific embodiments, it is clear that amendments and changes can be made to these embodiments without departing from the general scope as defined by the claims. In particular, individual features of the various embodiments illustrated/mentioned can be combined in additional embodiments. Therefore, the description and the drawings should be considered to be illustrative rather than restrictive.

The invention claimed is:

1. A multifunctional writing implement comprising a body that houses at least two writing elements, each writing element comprising a writing tip, a selection device that is designed for selecting a writing element from the at least two writing elements, and a retraction device that is designed for moving a selected writing element between a writing position in which the writing tip of the selected writing element projects from the body, and a retracted position in which the writing tip of the selected writing element is pulled in, the body comprising a front portion and a rear portion, the front portion and the rear portion being rotatable relative to one another, the selection device comprising a cam that is rotatably coupled to the rear portion and is designed to cooperate, in abutment, with the writing elements, the writing elements being rotatably coupled to the front portion, the retraction device comprising a ratchet mechanism, the ratchet mechanism comprising a piston that forms a single piece with the cam of the selection device.

2. A multifunctional writing implement according to claim 1, wherein the retraction device is rotatably coupled to the rear portion.

3. A multifunctional writing implement according to claim 1, wherein the ratchet mechanism comprises a rotary cam that cooperates, in abutment, with the cam of the selection device.

4. A multifunctional writing implement according to claim 1, wherein at least one writing element is a mechanical pencil, the retraction device making it possible to move a lead of the mechanical pencil forwards when the mechanical pencil is in the writing position.

5. A multifunctional writing implement according to claim 4, wherein the mechanical pencil comprises a writing head that is designed for bearing the lead, the lead forming a writing tip, the writing head projecting from the body when the mechanical pencil is selected using the selection device.

6. A multifunctional writing implement according to claim 4, wherein the mechanical pencil comprises a writing head that is designed for bearing the lead, the lead forming a writing tip, when the mechanical pencil is selected using the selection device, wherein the mechanical pencil is movable between an extended position in which the writing head projects from the body, and an indrawn position in which the writing head is pulled into the body via the retraction device, and when the mechanical pencil is in the extended position the retraction device makes it possible to move the lead forwards during a partial movement with respect to a required movement of the retraction device for moving the mechanical pencil from the extended position into the indrawn position.

7. A multifunctional writing implement according to claim 1, wherein the front portion and the rear portion are mounted on an intermediate portion and are movable in rotation relative to one another, wherein the cam of the selection device is designed to cooperate, in abutment, with cam followers of the writing elements, the writing elements being rotatably coupled to the front portion and borne by the intermediate portion, the intermediate portion comprising at least as many guides, extending over the entire length of the intermediate portion, as there are writing elements, each cam follower being received in a sliding manner in a guide.

8. A writing implement comprising a body sized to house two or more writing elements, the writing element comprising a writing tip, a selection device configured to select a writing element from the two or more writing elements, and a retraction device configured to move a selected writing element between a writing position in which the writing tip of the selected writing element projects from the body, and a retracted position in which the writing tip of the selected writing element is pulled in, the selection device comprising a cam that is configured to cooperate, in abutment, with the writing elements, the retraction device comprising a ratchet mechanism, the ratchet mechanism comprising a piston that is fixed relative to the cam of the selection device.

9. The writing implement according to claim 8, wherein the body includes a front portion and a rear portion, wherein the front portion and the rear portion are rotatable relative to one another.

10. The writing implement according to claim 9, wherein the cam of the selection device is rotatably coupled to the rear portion of the body.

11. The writing implement according to claim 9, wherein the writing elements are rotatably coupled to the front portion of the body.

12. The writing implement according to claim 8, wherein the cam of the selection device is coupled to the piston of the ratchet mechanism.

13. The writing implement according to claim 8, wherein the cam of the selection device forms a single piece together with the ratchet mechanism.

14. A writing implement comprising a body sized to house two or more writing elements, the writing element comprising a writing tip, a selection device configured to select a writing element from the two or more writing elements, and a retraction device configured to move a selected writing element between a writing position in which the writing tip of the selected writing element projects from the body, and a retracted position in which the writing tip of the selected writing element is pulled in, the selection device comprising a cam that is configured to cooperate, in abutment, with the writing elements, the retraction device comprising a ratchet mechanism, the ratchet mechanism comprising a piston that is integrally formed with the cam of the selection device, wherein at least one writing element is a mechanical pencil, the retraction device configured to move a lead of the mechanical pencil forwards when the mechanical pencil is in the writing position.

15. The writing implement according to claim 14, wherein the mechanical pencil comprises a writing head configured to bear the lead, the lead forming a writing tip, the writing head projecting from the body when the selection device selects the mechanical pencil.

16. The writing implement according to claim 1, wherein the rear portion is rotatable 360 degree relative to the front portion about an axial direction.

17. The writing implement according to claim 7, wherein the body that houses the at least two writing elements comprises a window portion, wherein the intermediate position comprises a first indicator and a second indicator, wherein only the first indicator of the first indicator and the second indicator is visible from an exterior of the writing implement through the window portion when a first writing element of the at least two writing elements has been selected by the selection device, and only the second indicator of the first indicator and the second indicator is visible from exterior of the writing implement through the window portion when a second element of the at least two writing elements has been selected by the selection device.

18. The writing implement according to claim 7, wherein the cam of the selection device includes a distally-facing concave recess and the each of the cam followers of the writing elements includes a proximally-facing convex shape configured to be received by the distally-facing concave recess.

19. The writing implement according to claim 1, further comprising a compression spring for compressing the ratchet mechanism.

20. The writing implement according to claim 1, wherein the ratchet mechanism further comprises a button projecting from a portion of the body, wherein activation of the button causes the retraction device to move the selected writing element between the writing position in which the writing tip of the selected writing element projects from the body, and the retracted position in which the writing tip of the selected writing element is pulled in.

* * * * *